United States Patent [19]

Beder

[11] Patent Number: 4,685,366

[45] Date of Patent: Aug. 11, 1987

[54] HOLDFAST CUTTING SYSTEM

[76] Inventor: Samuel L. Beder, R.R. 5, Box 84, Cape Elizabeth, Me. 04107

[21] Appl. No.: 763,299

[22] Filed: Aug. 7, 1985

[51] Int. Cl.[4] ..... B26D 3/02; B26D 7/02

[52] U.S. Cl. ..... 83/455; 83/466.1; 83/581; 83/824; 83/879; 384/39

[58] Field of Search ..... 83/455, 466.1, 761, 83/758, 581, 614, 824, 829, 879; 30/293, 294; 308/3 A, 3 R

[56] References Cited

U.S. PATENT DOCUMENTS

| | | | |
|---|---|---|---|
| 2,409,203 | 10/1946 | Gale | 83/614 |
| 3,964,360 | 6/1976 | Schwartz | 83/614 |
| 3,973,459 | 8/1976 | Stowe | 83/455 |
| 4,038,751 | 8/1977 | Albright | 30/293 |
| 4,570,516 | 2/1986 | Bruns | 83/614 |

FOREIGN PATENT DOCUMENTS

| | | | |
|---|---|---|---|
| 1316107 | 5/1973 | United Kingdom | 83/455 |

*Primary Examiner*—Frank T. Yost

*Assistant Examiner*—Hien H. Phan

[57] ABSTRACT

Lightweight, portable apparatus for cutting a wide range of materials available in sheet form, such as matboard, glass, light plastic, and leather. The invention lies in the unification of its cutting tool guide tract with the means of fixing in place the material to be cut. Four pegs are attached to the base of the apparatus for aligning the sheet to be cut. Equally important is the means by which it is automatically held in place during the cutting operation. Pieces of foam rubber or the like are inlaid in the base of the apparatus so that when the operator is pressing down on the cutting tool the resultant force normal to the supporting surface is sufficient to prevent lateral motion of the apparatus. Thus, no bulky and awkward clamping devices need to be used to affix the cutter to its supporting table. The apparatus also can be quickly converted into a T-square by attaching a cross-piece which mates with the base of the apparatus and in so doing defines a right angle with the combined guide track clamping plate.

3 Claims, 2 Drawing Figures

HOLDFAST CUTTING SYSTEM

BACKGROUND OF THE INVENTION

1. Field of the Invention

The present invention is a system for cutting flat sheets of material such as glass, cardboard, paper, and mat board used in the mounting of artwork. The device is designed so as to be capable of accommodating these diverse materials with little or no change in apparatus configuration. It provides the capability of cutting or scoring mat board at two different angles and has features which tend to hold the apparatus stable while the cutting is being carried out. The cutting is achieved by sliding a mount holding a razor blade (or other appropriate slicing instrument) along a track which guides the direction of the cut. The invention utilizes a combined track/brake piece which also serves to hold the workpiece in place. Pegs delineate the squaring off of the base supporting the workpiece so as to increase the efficiency with which rapid measurement and cutting can be achieved.

2. Description of Prior Art

There has been no shortage over the past 90 years of inventions for the cutting of materials such as mat boards of the type used for mounting paintings, drawings and the like. Presumably, this creative activity resulted from the continuing frustration encountered by persons trying to utilize the devices they had available for completing this basically simple operation. In reviewing the prior art as represented by U.S. Letters Patent, one observes that none of the prior art encompasses:

(1) a non-slip base;
(2) a single component which combines the guide track, the brake, and the clamp bar;
(3) the provision of both 45° and 90° guide tracks and brake on a single device;
(4) the capacity to cut materials other than mats and paper board, such as glass, light plastic, soft wood, leather and the like;
(5) lubricated motion of blade holder along guide rail;
(6) a T-square attachment;
(7) the capacity to outline on the mat the area to be cut out;
(8) base-mounted alignment pegs to ensure that the relative orientation of the sheet edges and the cut lines is well-defined.

Indeed, with very few exceptions, the prior art does not even manifest individual features providing the above capabilities. Attention is called to U.S. Pat. Nos. 4,413,542, 4,096,631, 4,022,095 3,996,827, 3,973,459, 3,964,360, 3,897,706, 3,779,119, 3,628,412, 3,527,131, 3,463,041, 3,213,736, 611,238, and 228,686.

SUMMARY OF THE INVENTION

The primary objective of the invention is to provide compact and inexpensive yet precise and easy-to-use apparatus for cutting or scoring a diverse range of materials available in sheet form. These materials include matboard, soft plastic, balsa wood, photo prints, leather, glass and others. Because most of these materials are used in the production and presentation of artwork and craftwork, it is anticipated that the invention will have greatest application in those fields. It is by no means limited to those fields, however; the invention will constitute a diversified cutting system, and not simply a matboard cutter. Nevertheless, since most if not all of the inventions described in the applicable prior art are presented as mat cutters, it is in the context of the mat cutting function that the invention is most easily described.

As has been amply pointed out in the more recent U.S. Letters Patent cited above, the mat and sheet cutting devices previously developed have retained a diversity of operating problems. The goals to be met by a cutting system such as that presented here include:(a) simplicity; (b) durability; (c)flexibility. More particularly, in the context of cutting a matbcard or similar sheet material, one wishes to have:

- a means of lining up the sheet on a planar support base;
- a means of producing either a vertical (90°) cut or a beveled (oblique, such as 45°) cut;
- a cutting instrument which moves smoothly, being impeded only by resistance in the material being cut;
- a means of quickly inserting and clamping down the sheet material constituting the workpiece and then of replacing it with another;
- a means of holding the workpiece firmly without marring it or, in the case of a brittle substance such as glass, breaking it;
- a simple means to ensure that the apparatus remains in one place throughout the cutting operation.

The present invention addresses these various goals as follows. A sealed wooden base provides both the planar undersupport for the workpiece and the interface between the apparatus and the work table on which it is used. The system is intended as a portable cutter and it is presumed that it will be generally placed on a tabletop not specifically designed for it. In order to prevent said tabletop from being marred and, more importantly, to provide a means of easily holding the apparatus fixed during the cutting operation, the foam rubber strips or some other adherent, soft substance of that nature are laid and cemented into grooves placed for that purpose in the underside of the wooden base. This ensures that when one applies the force normal to the table associated with pushing the cutting blade through the material to be cut, the soft understrips will be pressed against the table top and hence will resist motion across the tabletop which otherwise would follow in response to the lateral forces applied during the cutting operation. In order to minimize the lateral forces, the base contains channels which accommodate that part of the blade which extends through the sheet being cut in such a way as to ensure that the blade only passes through the workpiece and not the supporting planar surface.

The sheet to be cut needs to be aligned and then clamped down so that it will remain in a fixed position and orientation during the cutting process. The present invention achieves this function with four alignment pegs and a unitary metal piece which is a combination brake, guide track, and clamp. It is held to the wooden base by two spring-loaded screws.

PREFERRED EMBODIMENT OF THE INVENTION

Figure 1:
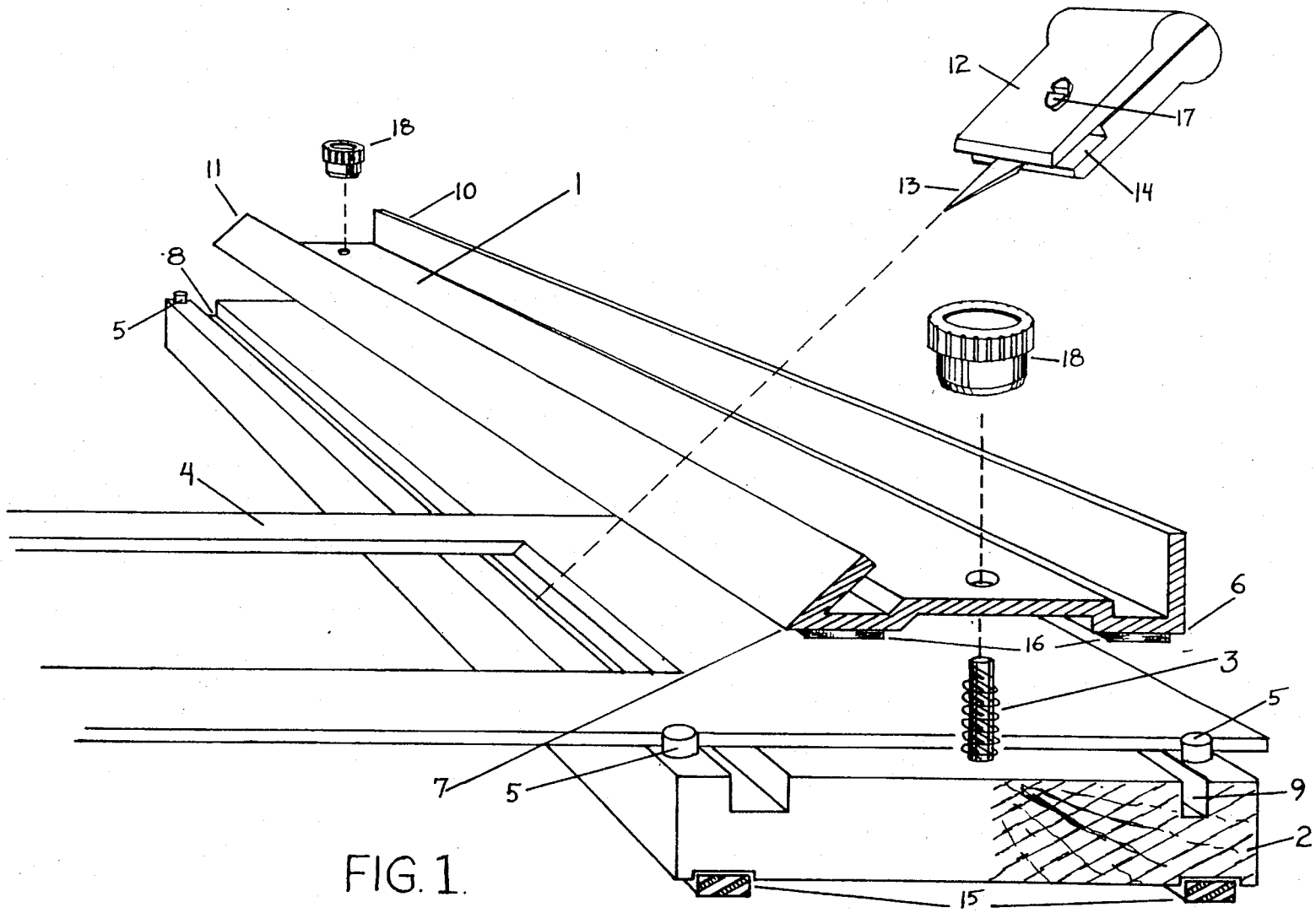
FIG. 1 is a perspective view of the invention depicting all of the significant features of the preferred embodiment of the invention.
Figure 2:
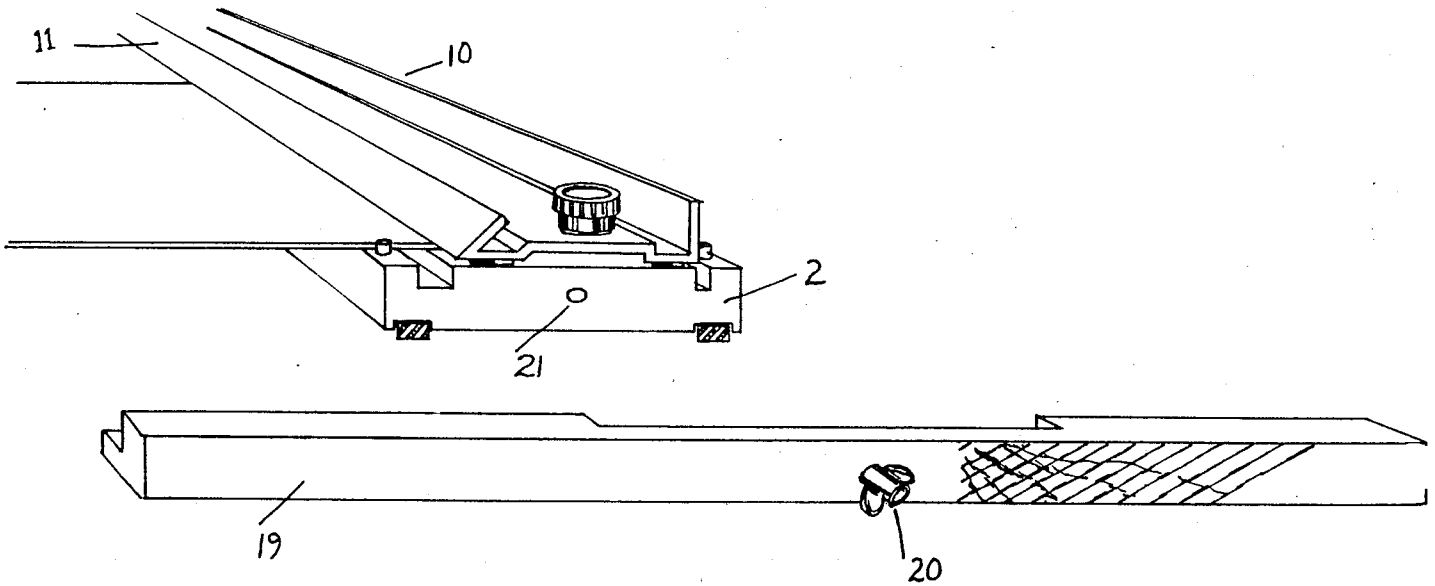
FIG. 2 shows the same perspective view as FIG. 1, but with the T-square accessory attached.

In its preferred embodiment, the invention utilizes for the unitary track/brake/clamp a single piece 1 of smooth mill-ready or anodized aluminum or the like. Said track/brake/clamp is removably attached to the wooden or the like base 2 by means of tightening knobs 18 onto spring-loaded machine screws 3 affixed to the base and passing through holes drilled at each end of the aluminum piece. With the knobs 18 loosened, the sheet 4 to be cut is lined up using the alignment pegs 5 which are placed in the respective four corners of the base in such a way as to define lines parallel and perpendicular to the two tracks 10 and 11. The two edges 6 and 7 in turn define the bottom edges of the respective guide tracks 10 and 11. Guide track 10 defines a direction perpendicular to the base plane and thus to the plane of the workpiece. When the slotted cutting carriage 12 which may be manufactured of metal or the like with its associated blade 13 is placed on that part of the aluminum piece which constitutes the 90° guide track 10, a 90° cut can be made in the workpiece by sliding said slotted cutting carriage 12 along said guide track 10. Alternatively, when the slotted cutting carriage 12 containing the blade 13 is mounted on the 45° guide track 11, a 45° (beveled) cut can be made in the workpiece.

Two channels 8 and 9 in the base 2 are located so that they lie directly under the respective two guide tracks 10 and 11 when the track/brake/clamp 1 is attached to the wooden base 2. The function of said channels 8 and 9 is to provide clearance for that portion of the cutting blade 13 which extends through the bottom side of the workpiece 4. The blade 13 and cutting carriage 12 are held in place by means of screw 17.

In order to provide appropriate non-marring support for the apparatus, two foam rubber strips 15, are cemented into the bottom of the wooden base 2. This arrangement provides the simple means desired for forestalling sideways motion of the apparatus in response to the lateral force necessarily applied during the cutting of the workpiece. In order to minimize that lateral force, the preferred embodiment provides a lubricated interface between the guide tracks 10 and 11, on the one hand, and the slotted cutting carriage 12 on the other. The surface of the slot 14 by which the slotted cutting carriage 12 is mounted on the guide track 10 or 11 is lined with Teflon[1] tape or similar low coefficient of friction synthetic durable smooth material available in thin sheets or tape. This technique, when combined with the corrosion-resistant surface of the aluminum guide track, provides an enduring low coefficient of friction between the slotted cutting carriage 12 and the guide track 10 or 11 on which it is to glide.

[1] Registered Trademark.

In order to provide a firm yet non-stressing and non-marring surface with which to clamp and grip the workpiece, the preferred embodiment incorporates felt pads 16 on the underside of the aluminum track/brake/clamp piece 1. The wooden base 2 itself constitutes a sufficiently yielding surface that the additional cushioning is unnecessary on the surface which supports the workpiece from below.

As a means of expanding the applications possible with the basic apparatus, a cross-piece attachment 19 is provided which mates with the wooden base 2 by means of a wingnut 20 which screws into a hole 21 in the center of one end of the wooden base, resulting in a T-square. That is, when attached, the cross-piece 20 makes a right angle with the direction defined by the guide tracks 10 and 11.

I claim:

1. Apparatus for cutting and scoring sheets of material, comprising:

(a) a planar base for supporting said sheets of material where said base is a rectangle and incorporates a plurality of parallel longitudinal channels;

(b) a clamping means for holding said material to said base where said clamping means comprises a generally planar rectangular aluminum plate of a width defined by the inner edges of said longitudinal channels in said planar base and of a length defined by the length of said planar base, possessing upward-turning rims, parallel to said longitudinal channels, oriented at 90° and 45° , respectively, with respect to the plane defined by said plate, and where said clamping means is secured by said plate, and where said clamping means is secured to said planar base by tightening knurled nuts onto vertical machine screws which support springs coaxial with said screws, said screws passing through holes at the centers of opposite ends of both said clamping means and said planar base, thereby fastening said clamping means to said planar base;

(c) a cutting and scoring means that comprises a razor-sharp blade of adjustable exposed length fixed firmly in a slotted cutter carriage, which said slotted cutter carriage fits slideably over said upward-turning rims of said clamping means, said upward-turning rims in combination with said cutter carriage making possible the slideable mounting and guiding of said cutting and scoring means so that said blade can pass through said sheets of material into said longitudinal channels without cutting into said planar base and so that said cutting and scoring means can be guided in a straight line along the surface of said sheets;

(d) lubricating means to enable said slotted cutter carriage to slide smoothly along said clamping means, said lubricating means comprising thin sheets of low coefficient of friction synthetic coating where said low coefficient of friction synthetic coating is affixed to the inner slotted surface of said slotted cutter carriage such that said synthetic coating is in direct contact with said upward-turning rims;

(e) adherent means to prevent movement of said apparatus while said sheets of material are being processed with said apparatus, said adherent means comprising two longitudinal strips attached to underside of said planar base substantially directly under said longitudinal channels, said longitudinal strips having foam rubber-like adherence and resilience;

(f) cushioning means to provide a firm but soft interface between said sheets of material and said clamping means, said cushioning means comprising non-marring pads affixed to the underside of said clamping means thereby ensuring that when said clamping means is tightened against said planar base with said sheets of material between said clamping means and said planar base the top of said sheet of material is prevented from directly contacting said clamping means;

(g) alignment means to define the position of said sheets of material during processing, said alignment means comprising four pegs securely mounted on the top of said planar base, with each of said four pegs located substantially at one of the four corners of said planar base, said pegs defining lines normal and parallel, respectively, to said longitudinal channels in said planar base.

2. Apparatus as defined in claim 1 wherein said cutting means comprises an instrument capable of cutting and scoring glass.

3. Apparatus as defined in claim 1 wherein said clamping means is augmented by a crosspiece attached to one end of said planar base such that it makes a right angle with said planar base and said clamping means so as to constitute a T-square.

* * * * *